US006866784B2

(12) United States Patent
Chang et al.

(10) Patent No.: US 6,866,784 B2
(45) Date of Patent: Mar. 15, 2005

(54) SLURRY RECYCLING SYSTEM AND METHOD FOR CMP APPARATUS

(75) Inventors: Jung Hoon Chang, Seoul (KR); Kwang Jun Lee, Gyeonggi-do (KR); Jin Goo Park, Gyeonggi-do (KR)

(73) Assignee: Nymtech, Co., Ltd., Incheon (KR)

( * ) Notice: Subject to any disclaimer, the term of this patent is extended or adjusted under 35 U.S.C. 154(b) by 199 days.

(21) Appl. No.: 10/311,274

(22) PCT Filed: Jun. 27, 2001

(86) PCT No.: PCT/KR01/01095

§ 371 (c)(1),
(2), (4) Date: Dec. 16, 2002

(87) PCT Pub. No.: WO02/01618

PCT Pub. Date: Jan. 3, 2002

(65) Prior Publication Data

US 2003/0189004 A1 Oct. 9, 2003

(30) Foreign Application Priority Data

Jun. 27, 2000 (KR) ..... 2000-35746
Jun. 27, 2000 (KR) ..... 2000-35747

(51) Int. Cl.[7] ..... B01D 61/00

(52) U.S. Cl. ..... 210/652; 210/651; 210/641; 210/195.2; 210/257.2; 210/639; 134/10; 134/902

(58) Field of Search ..... 210/651, 652, 210/641, 195.2, 257.2, 639; 134/902, 10

(56) References Cited

U.S. PATENT DOCUMENTS 5,647,989 A * 7/1997 Hayashi et al. ..... 210/641
6,183,352 B1 * 2/2001 Kurisawa ..... 451/87
6,203,705 B1 * 3/2001 James et al. ..... 210/638
6,254,779 B1 * 7/2001 Jeffery et al. ..... 210/620
6,379,538 B1 * 4/2002 Corlett et al. ..... 210/96.1
6,482,325 B1 * 11/2002 Corlett et al. ..... 210/662
6,508,695 B2 * 1/2003 Tanikawa et al. ..... 451/41
6,656,359 B1 * 12/2003 Osuda et al. ..... 210/636

FOREIGN PATENT DOCUMENTS

JP 10-216554 * 8/1998
JP 11-10540 * 11/1999
JP 2000-190223 * 11/2000
WO WO 02/01618 * 1/2002

* cited by examiner

*Primary Examiner*—Ana Fortuna
(74) *Attorney, Agent, or Firm*—McGuireWoods, LLP

(57) ABSTRACT

A slurry recycling system for use in a chemical mechanical polishing (CMP) apparatus for polishing a workpiece by using a slurry containing an abrasive, a pH agent and a deionized water is provided. The slurry recycling system includes a slurry collection tank for storing the slurry used in the CMP apparatus as a recyclable slurry; an ultra filter for separating, from the recyclable slurry, a fluid ingredient containing the pH agent and the deionized water and the abrasive to allow the abrasive to be reintroduced into the slurry collection tank; and a reverse osmosis filter for separating, from the fluid ingredient, the pH agent and the deionized water to allow the pH agent to be reintroduced into the slurry collection tank and to allow the deionized water to be discharged out.

7 Claims, 2 Drawing Sheets

SLURRY RECYCLING SYSTEM AND METHOD FOR CMP APPARATUS

FIELD OF THE INVENTION

Figure 1:
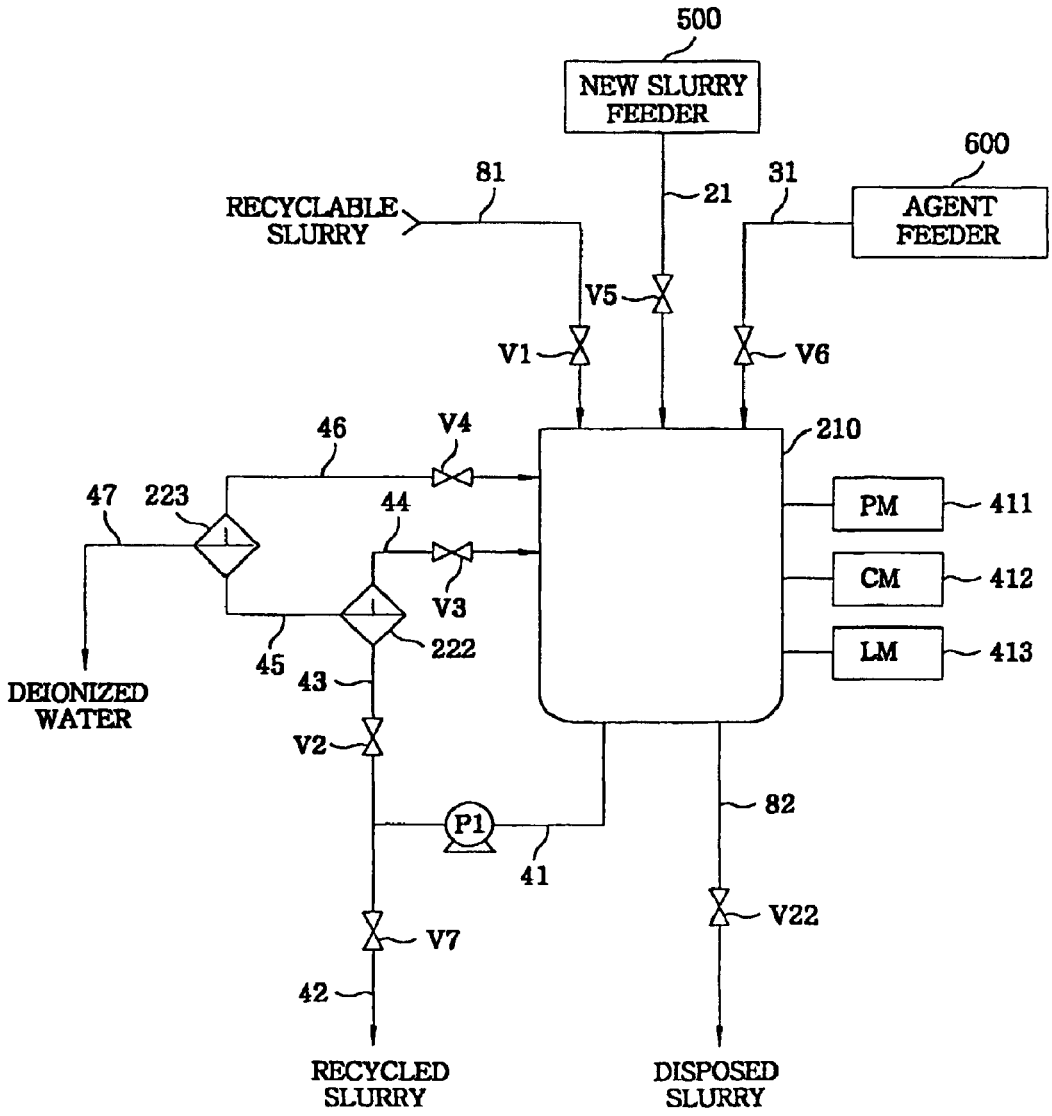

The present invention relates to a slurry recycling system and method for use in a chemical mechanical polishing (CMP) apparatus; and, more particularly, to a slurry recycling system and method for use in a CMP apparatus capable of recycling a recyclable slurry by recovering a pH agent therefrom and discharging deionized water through a two-step filter with an ultra filter and a reverse osmosis filter.

BACKGROUND OF THE INVENTION

A CMP apparatus is a semiconductor apparatus for polishing a wafer chemically and mechanically. In general, the CMP apparatus includes a carrier for holding the wafer and a surface plate with a polishing pad attached on a top surface thereof. The wafer is pressed against a top of the polishing pad by the carrier. In this state, the surface plate and the carrier can be rotated relative to each other. A new slurry is continuously supplied from a slurry feeder to the top of the polishing pad, so that the precision of polishing and polishing rate of the wafer can be improved.

Two types of slurry are conventionally used for the polishing of the wafer. One is of a slurry containing ammonia-fumigated silica for polishing an interlayer insulating film of the wafer and the other is of a slurry containing alumina for polishing a metal film. The former is of an alkali slurry of about pH 11 containing a predetermined concentration of silica uniformly distributed in deionized water while the latter is of an acid slurry of about pH 2 to 4 containing an oxide agent for oxidizing a metal dissolved in the deionized water. Accordingly, the selection of the slurry type is made depending on whether the interlayer insulation film of the wafer is to be polished or the metal films are to be polished. Whichever the case may be, both the concentration of the abrasives such as silica and so on and the pH of the slurry should be maintained at a predetermined level and a predetermined range, respectively, in order to obtain a desired polishing rate.

However, the conventional CMP process has a certain drawback in that the deionized water used to dilute the concentration of the slurry or to clean the wafer in the CMP process causes several undesirable side effects. For example, since the deionized water causes the concentration and the pH of the slurry after the CMP process to be changed to those different from the predetermined desired level and range, the polishing rate and flatness of the wafer are greatly reduced and, therefore, the slurry once used cannot be reused.

Since the slurry once used is accommodated in a waste bath and thrown away, a great amount of slurry is wasted during the CMP process and, therefore, polishing costs increase. Further, a considerable amount of pH agent discharged out without being recovered causes environmental pollution.

SUMMARY OF THE INVENTION

It is, therefore, an object of the present invention to provide a cost effective and environment-friendly slurry recycling system and method for use in a CMP apparatus capable of recycling a recyclable slurry by recovering a pH agent and discharging deionized water through a two step filtering with an ultra filter and a reverse osmosis filter.

In accordance with one aspect of the present invention, there is provided a slurry recycling system for use in a chemical mechanical polishing (CMP) apparatus for polishing a workpiece by using a slurry containing an abrasive, a pH agent and deionized water, the system comprising:

a slurry collection tank for storing the slurry used in the CMP apparatus as a recyclable slurry;

an ultra filter for separating, from the recyclable slurry, a fluid ingredient containing the pH agent and the deionized water and the abrasive to allow the abrasive to be reintroduced into the slurry collection tank; and a reverse osmosis filter for separating, from the fluid ingredient, the pH agent and the deionized water to allow the pH agent to be reintroduced into the slurry collection tank and to allow the deionized water to be discharged out.

BRIEF DESCRIPTION OF THE INVENTION

Figure 2:
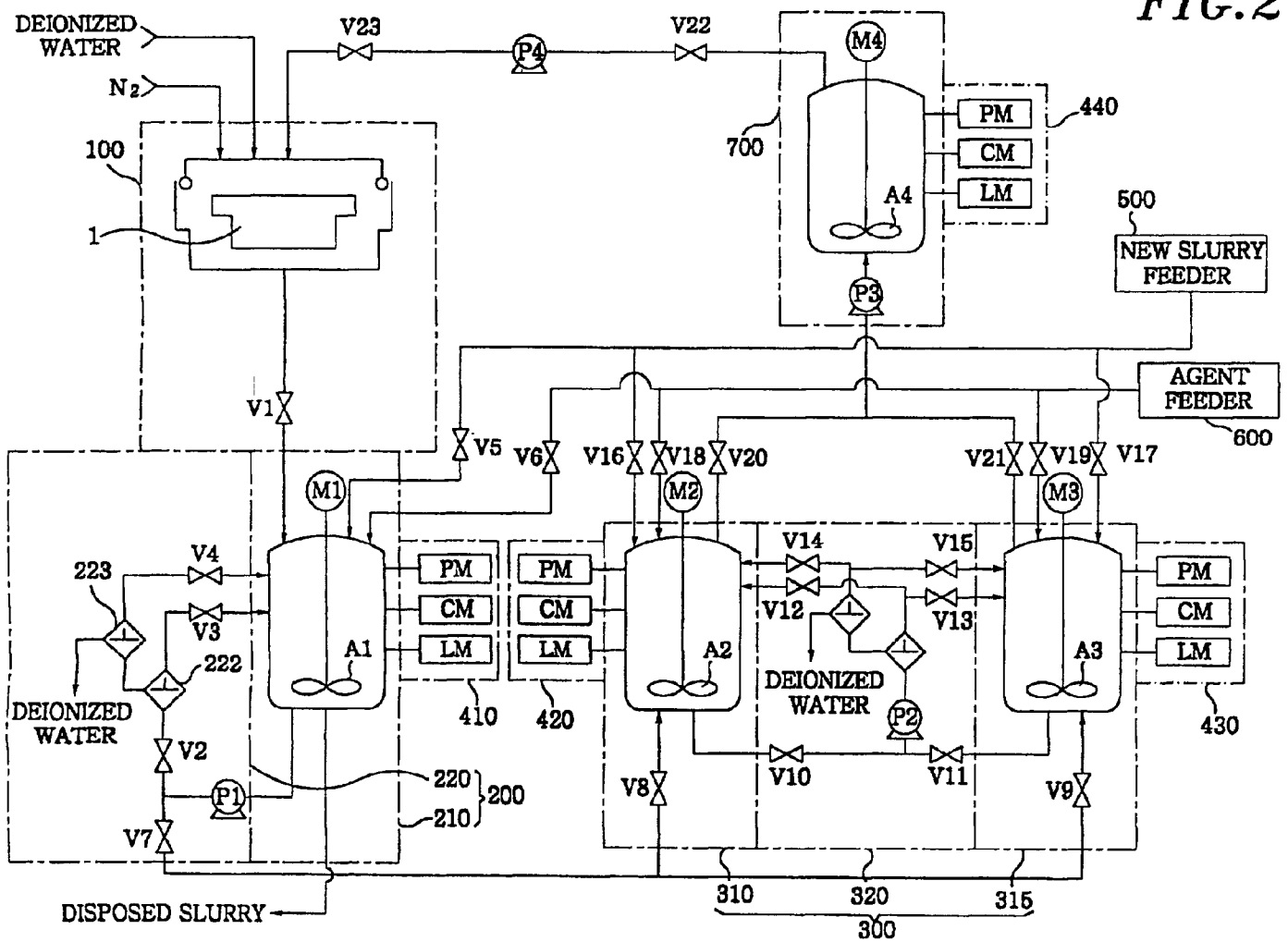

The above and other objects and features of the present invention will become apparent from the following description of preferred embodiments given in conjunction with the accompanying drawings, in which:

FIG. 1 describes a slurry recycling system for a CMP apparatus in accordance with a first embodiment of the present invention; and FIG. 2 illustrates a slurry recycling system for a CMP apparatus in accordance with another embodiment of the present invention.

DESCRIPTION OF SPECIFIC EMBODIMENTS

FIG. 1 is a schematic drawing for describing a slurry recycling system for use in a CMP apparatus in accordance with a first embodiment of the present invention.

The slurry recycling system includes a slurry collection tank 210, a new slurry feeder 500, an agent feeder 600, an ultra filter 222, a reverse osmosis filter 223, a pump P1 and valves V1 to V7 and V22.

In a slurry recycling mode, the valves V1 to V4 are kept open. The slurry discharged after being used to polish the wafer is subjected to a recycling process and collected as a recyclable slurry in the slurry collection tank 210 through a recyclable slurry feed line 81. The valve V1 controls a flow rate of the recyclable slurry being introduced into the slurry collection tank 210. The pump P1 pumps the recyclable slurry stored in the slurry collection tank 210 so that the recyclable slurry may be forced to be compulsively circulated.

The recyclable slurry is provided to the ultra filter 222 through slurry circulating passages 41 and 43 and the valve V2. Then, the ultra filter 222 separates a solid ingredient and a fluid ingredient from the recyclable slurry, wherein the solid ingredient includes an abrasive such as silica and the fluid ingredient contains a pH agent such as potassium hydroxide dissolved into deionized water. The solid ingredient is reintroduced into the collection tank 210 by way of a slurry circulating passage 44 and the valve V3 while the fluid ingredient is sent to the reverse osmosis filter 223 through a slurry circulating passage 45. Herein, some of the pH agent may be introduced into the collection tank 210 with the solid ingredient. The valve V3 controls the flow rate of the solid ingredient and, if any, some of the pH agent reverted into the collection tank 210.

A buffer tank (not shown) for cleaning the ultra filter 222 may be additionally installed on the slurry circulating passage 45, if required. The pH agent and the deionized water collected into the buffer tank may be used to perform a back washing for the ultra filter 222. Through this function, the buffer tank helps the ultra filter 222 to separate the solid ingredient from the fluid ingredient effectively.

The reverse osmosis filter 223 has been developed based on the fact that only pure water can permeate a membrane. If a pressure is applied to the membrane, highly purified water can be obtained. When the fluid ingredient of the recyclable slurry, after the solid ingredient being separated therefrom, is provided to the reverse osmosis filter 223 through the slurry circulating passage 45, the reverse osmosis filter 223 separates the pH agent and the deionized water from the fluid ingredient in accordance with a reverse osmosis principle. Then, the pH agent is reintroduced into the slurry collection tank 210 through a slurry circulating passage 46 and the deionized water is discharged out through a discharge tube 47. The valve V4 controls a flow rate of the pH agent being reintroduced into the collection tank 210 through the slurry circulating passage 46.

A pH meter 411, a concentration meter 412 and a level meter 413 prepared at the collection tank 210 measure the pH, the concentration and the stock amount of the recyclable slurry, respectively. The slurry recycling process described above is performed continuously until the concentration and the pH of the recyclable slurry reach a predetermined level and a predetermined range, respectively. In case an alkali slurry is used in accordance with the present invention, it is preferable that the pH thereof is set to be about 10 to 11 and a weight thereof, from which the concentration thereof can be estimated, is set to be about 1.070 to 1.074.

If the concentration of the recyclable slurry does not satisfy a predetermined condition on the value, the new slurry feeder 500 supplies to the slurry collection tank 210 new slurry having a concentration higher than that of the recyclable slurry to be recycled in the collection tank 210. The valve V5 controls a flow rate of the new slurry being introduced into the slurry collection tank 210 through a new slurry supplying line 21.

Further, if the pH of the recyclable slurry does not reach the predetermined range, the agent feeder 600 provides a pH agent such as potassium hydroxide (KOH) to the slurry collection tank 210. The valve V6 controls a low rate of the pH agent being introduced into the slurry collection tank 210 through a pH agent supplying line 31.

If the concentration of the recyclable slurry is equal to or larger than the predetermined level and the pH thereof enters the predetermined range, the slurry recycling mode is replaced with a slurry supplying mode. In the slurry supplying mode, the valve V2 is kept closed while the valve V7 is kept open such that the recyclable slurry stored in the slurry collection tank 210 can be finally outputted as a recycled slurry through a recycled slurry supplying line 42. The recycled slurry may be sent to either the CMP apparatus to be used in the CMP process or another slurry recycling system.

However, if the recyclable slurry is actually determined to be unrecyclable since the concentration thereof is smaller than the predetermined level or the pH thereof does not satisfy a predetermined condition on the range, the slurry recycling mode is replaced with a waste slurry discharging mode. In the waste slurry discharging mode, the valves V2 and V7 are kept closed while the valve V22 is kept open so that the recyclable slurry in the slurry collection tank 210 is discharged out as a waste slurry.

The slurry recycling system for use in the CMP apparatus configured as described above operates as follows.

First, a to-be-polished workpiece such as a wafer is placed on a top surface of a rotating polishing pad of the CMP apparatus. Then, a slurry with a proper concentration maintained by an appropriate amount of deionized water is provided onto the polishing pad, so that the workpiece may be polished. Thereafter, the slurry used is transferred as the recyclable slurry to the slurry collection tank 210 through the recyclable slurry feed line 81. Herein, the valve V1 controls the flow rate of the recyclable slurry being introduced into the slurry collection tank 210.

The pH meter 411 and the concentration meter 412 installed at the slurry collection tank 210 estimate the pH and the concentration of the recyclable slurry, respectively. If the concentration and the pH of the recyclable slurry do not satisfy a predetermined condition on the level or range, the recyclable slurry is determined to be not adequate for reuse in the polishing process. Then, the waste slurry discharging mode is initiated by turning the valve 22 open so that the recyclable slurry in the slurry collection tank 210 is discharged out as the waste slurry through the valve V22.

In the slurry recycling mode, the pump P1 pumps the recyclable slurry in the slurry collection tank 210 and only the valves V1 to V4 are kept open while the other valves are kept closed.

From the recyclable slurry, the ultra filter 222 separates the slid ingredient containing, e.g., silica from the fluid ingredient containing the pH agent. Depending on the type of the ultra filter 222 and the pressure applied to the ultra filter 222, the solid ingredient with a greater size than a predetermined size is reintroduced into the slurry collection tank 210. On the other hand, the fluid ingredient including the pH agent dissolved in the deionized water passes through the ultra filter 222 and is transferred to the reverse osmosis filter 223.

From the fluid ingredient of the recyclable slurry, from which the solid ingredient has been removed, the reverse osmosis filter 223 in accordance with the present invention separates the pH agent from the deionized water. Then, the pH agent is reintroduced into the slurry collection tank 210 through the slurry circulating passage 46 while the deionized water is disposed of through the discharge tube 47.

The slurry recycling processs described above is continued until the concentration of the recyclable is equal to or larger than the predetermined level and the pH of the recyclable slurry reaches the predetermined range.

The valve V5 may turn to be open before, during or after the slurry recycling process if required so that a new slurry with a high concentration may be supplied from the new slurry feeder 500 through the new slurry supplying line 21 to the slurry collection tank 210. Further, if necessary, the valve V6 may be opened to provide the pH agent such as KOH from the agent feeder 600 to the slurry collection tank 210.

If the recyclable slurry is completely recycled as a recycled slurry with the concentration and the pH adequate for polishing the wafer, the slurry supplying mode is initiated. In the slurry supplying mode, the valves V1 to V4 are kept closed while only the valve V7 is kept open so that the slurry in the slurry collection tank 210 may be outputted as the recycled slurry.

Referring to FIG. 2, there is provided a schematic drawing for describing a slurry recycling system for a CMP apparatus in accordance with a second embodiment of the present invention. The slurry recycling system comprises includes a slurry recovering unit 100, a slurry pre-treatment recycling module 200, a slurry after-treatment recycling module 300, a feature detecting units 410 to 440, the new slurry feeder 500, the agent feeder 600 and a recycled slurry feeder 700.

The slurry recovering unit 100 is positioned around a polishing pad 1 of the CMP apparatus to recover the slurry used to polish the workpiece.

The slurry pre-treatment recycling module 200 includes, as shown in the slurry recycling system of FIG. 1, a slurry collection tank 210 for storing the recovered recyclable slurry, a slurry filtering unit 220 for separating the solid ingredient containing abrasives and the pH agent such as KOH from the recyclable slurry. The slurry filtering unit 220 has an ultra filter 222 and a reverse osmosis filter 223.

The ultra filter 222 separates a solid ingredient containing the abrasives such as silica from the recyclable slurry and then provides the separated solid ingredient to the slurry collection tank 210. The other ingredients of the recyclable slurry beside the solid ingredient are provided to the reverse osmosis filter 223.

Then, the reverse osmosis filter 223 separates from the received recyclable slurry, from which the solid ingredient has been removed, the pH agent and the deionized-water. The pH agent is reintroduced into the slurry collection tank 210 and the deionized water is discharged out.

The feature detecting unit 410 has a pH meter, a concentration meter and a level meter for estimating the pH, the concentration and the stock amount of the recyclable slurry, respectively. If the pH and the concentration of the recyclable slurry detected in the feature detecting unit 410 satisfy a predetermined condition on the level and range, respectively, the recycling mode of the slurry pre-treatment recycling module 200 is replaced with the slurry supplying mode. In the slurry supplying mode, the valve V2 is kept closed while the valve V7 is kept open so that the recyclable slurry in the slurry pre-treatment recycling module 200 is provided as a first recycled slurry to the slurry after-treatment recycling module 300.

The slurry after-treatment recycling module 300 has a plurality of slurry collection tanks 310 and 315 and a slurry filtering unit 320 for recovering solid ingredient containing abrasives and pH agent such as KOH from the first recycled slurry.

It should be noted that the slurry after-treatment recycling module 300 has the plurality of slurry collection tanks 310 and 315, and the number of the slurry filtering unit 320 is smaller than that of the slurry collection tanks 310 and 315. Accordingly, one slurry filtering unit 320 selectively recycles the slurry stored in one of the plurality of slurry collection tanks 310 and 315. While a first recycled slurry in the selected collection tank 310 is provided to a recycled slurry feeder 700 as a second recycled slurry, a first recycled slurry in the other slurry collection tank 315 is continuously recycled through the slurry filtering unit 320 until the pH and concentration thereof satisfy the predetermined condition on the range and level, respectively.

The slurry filtering unit 320 of the slurry after-treatment recycling module 300 has a same structure and performs a same function as the slurry filtering unit 220 in the slurry pre-treatment recycling module 200.

The new slurry feeder 500 supplies new slurry whose concentration is higher than that of the first recycled slurry to the slurry pre/after-treatment recycling module 200 and 300, if required.

The agent feeder 600 provides, if required, the pH agent such as KOH to the slurry pre/after-treatment recycling module 200 and 300.

The recycled slurry feeder 700 supplies a second recycled slurry which has been recycled through the slurry after-treatment recycling module 300 to the polishing pad 1 of the CMP apparatus.

The feature detecting units 410 to 440 estimate chemical characteristics of the slurry stored in the pre/after-treatment recycling modules 200 and 300 and the recycled slurry feeder 700. To be specific, a pH meter, a weight meter and a level meter of the feature detecting units 410 to 440 calculate the pH, the concentration and the stock amount of the slurry, respectively.

A controller (not shown) controls feed rates of the new slurry and the pH agent as well as the recycling number of the pre/after-treatment recycling modules 200 and 300 depending on the estimated feature obtained from the feature detecting units 410 to 440. Further, the controller controls the whole recycling process in accordance with a preset program.

Reference characters M1 to M4, A1 to A4, P1 to P4 and V1 to V23 refer to motors, stirrers, pumps and valves, respectively.

The CMP slurry recycling system having the above configurations operates as follows.

First, a to-be-polished workpiece such as a wafer is polished on the polishing pad 1 of the CMP apparatus. The slurry used in the polishing process is recovered by the slurry recovering unit 100 and is provided into the slurry collection tank 210 of the slurry pre-treatment recycling module 200.

In general, the recyclable slurry does not exhibit chemical characteristics, e.g., concentration and pH, adequate for use in polishing the wafer. Accordingly, the recyclable slurry should be recycled through a recycling process in the slurry filtering unit 220. The slurry filtering unit 220 recycles the recyclable slurry through the same process as described in FIG. 1.

If a first slurry recycling process is completed by the slurry pre-treatment recycling module 200, the valve V2 is kept closed while the valve V7 is kept open so that the recyclable slurry may be pumped as a first recycled slurry to the slurry after-treatment recycling module 300.

Thereafter, a new slurry and/or pH agent may be added, if required, in the slurry after-treatment recycling module 300 by employing a same principle as in the first slurry recycling process, and a second slurry recycling process may be conducted by a slurry filtering unit 320. The detailed description of the second recycling process will be omitted because it can be readily inferred from the first recycling process as described above.

If the second slurry recycling process in the slurry after-treatment recycling module 300 is finished, the valve V20 or V21 is kept open and the pump P3 operates so that the first recycled slurry in the slurry collection tank 310 or 315 is forced into the recycled slurry feeder 700 as a second recycled slurry.

Then, the feature detecting unit 440 finally checks chemical characteristics of the recycled slurry. If the recycled slurry is determined to have adequate characteristics for reuse in a successful polishing process, the valves V22 and V23 turn to be open and the pump P4 operates so that the recycled slurry is re-supplied to the polishing pad 1 of the CMP apparatus.

Since the slurry should be continuously provided to the polishing pad 1 of the CMP apparatus, slurry pumping processes of the pumps P3 and P4 should also be kept on continuously.

However, if the slurry filtering unit 320 in the slurry after-treatment recycling module 300 filters respective slurries stored in the slurry collection tanks 310 and 315 simultaneously and the valves V20 and V21 are concurrently opened such that respective first recycled slurries in the slurry collection tanks 310 and 315 may be pumped by the pump P3 at the same time, the second recycled slurry completely recycled in the slurry after-treatment recycling module 300 may be mixed with the newly introduced first recycled slurry and the mixture may be provided to the recycled slurry feeder 700. In order to prevent this, the slurry after-treatment recycling module 300 includes the plurality of slurry collection tanks 310 and 315 and operates as follows: while the valve V20 is opened so that the first recycled slurry in the slurry collection tank 310 is pumped as the second recycled slurry to the recycled slurry feeder 700, the valve V21 is kept closed so that the slurry filtering unit 320 secondly recycles the first recycled slurry stored in the slurry collection tank 315. To the contrary, in case the first recycled slurry in the slurry collection tank 315 is pumped as the second recycled slurry, the first recycled slurry in the slurry collection tank 310 is subjected to the second slurry recycling process by the filtering unit 320.

As described above, by recycling the used slurry in accordance with the slurry recycling method and system of the present invention, costs for CMP work and environmental contamination can be effectively diminished.

While the invention has been shown and described with respect to the preferred embodiments, it will be understood by those skilled in the art that various changes and modifications may be made without departing from the spirit and scope of the invention as defined in the following claim.

What is claimed is:

1. A slurry recycling system for use in a chemical mechanical polishing (CMP) apparatus for polishing a workpiece by using a slurry containing an abrasive, a pH agent and deionized water, the system comprising:

a slurry collection tank for storing the slurry used in the CMP apparatus as a recyclable slurry;

an ultra filter for separating, from the recyclable slurry, a fluid ingredient containing the pH agent and the deionized water and the abrasive to allow the abrasive to be reintroduced into the slurry collection tank; and a reverse osmosis filter for separating, from the fluid ingredient, the pH agent and the deionized water to allow the pH agent to be reintroduced into the slurry collection tank and to allow the deionized water to be discharged out.

2. The system of claim 1, further comprising a new slurry feeder for supplying to the slurry collection tank a new slurry whose concentration is higher than that of the recyclable slurry.

3. The system of claim 1, further comprising an agent feeder for supplying the pH agent to the slurry collection tank.

4. The system of claim 1, wherein a plurality of slurry collection tanks are prepared and, while the recyclable slurry stored in at least one of the plurality of slurry collection tanks is being provided as a recycled slurry to the CMP apparatus, the recyclable slurry stored in at least one other of the slurry collection tanks is sent to the ultra filter.

5. The system of claim 1, further comprising a back washing unit for collecting the fluid ingredient and allowing the fluid ingredient to perform a back washing for the ultra filter.

6. A slurry recycling method for use in a CMP apparatus for polishing a workpiece by using a slurry containing a abrasive, a pH agent and deionized water, the method comprising the steps of:

collecting the slurry used in the CMP apparatus as a recyclable slurry and storing the recyclable slurry in a slurry collection tank;

separating, from the recyclable slurry, a fluid ingredient containing the pH agent and the deionized water and the abrasive to reintroduce the abrasive into the slurry collection tank; and separating, from the fluid ingredient, the pH agent and the deionized water to reintroduce the pH agent into the slurry collection tank and to discharge out the deionized water.

7. The method of claim 1, wherein a plurality of slurry collection tanks are prepared and, while the recyclable slurry stored in at least one of the plurality of slurry collection tanks is being provided as a recycled slurry to the CMP apparatus, the recyclable slurry stored in at least one other of the slurry collection tanks is sent to the ultra filter.

* * * * *